US007057345B2

(12) United States Patent
Kikuchi et al.

(10) Patent No.: US 7,057,345 B2
(45) Date of Patent: Jun. 6, 2006

(54) SHORT ARC DISCHARGE LAMP AND LIGHT SOURCE DEVICE

(75) Inventors: Yasuro Kikuchi, Himeji (JP); Yoichiro Higashimoto, Himeji (JP); Takeo Matsushima, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/618,615

(22) Filed: Jul. 15, 2003

(65) Prior Publication Data

US 2004/0075390 A1 Apr. 22, 2004

(30) Foreign Application Priority Data

Jul. 23, 2002 (JP) ..... 2002-213298

(51) Int. Cl.
*H01J 1/46* (2006.01)
*H01J 1/02* (2006.01)

(52) U.S. Cl. ..... 313/595; 313/601; 313/631; 313/574

(58) Field of Classification Search ..... 313/631, 313/491, 492, 574, 620, 239, 571, 570, 617, 313/595, 601
See application file for complete search history.

(56) References Cited

U.S. PATENT DOCUMENTS 2,087,735 A * 7/1937 Pirani et al. ..... 313/42
3,611,015 A * 10/1971 Kim ..... 315/265
3,716,743 A * 2/1973 Mizuno et al. ..... 313/625
3,840,768 A * 10/1974 White et al. ..... 313/617
3,995,928 A * 12/1976 Shaffner et al. ..... 315/60
4,599,540 A * 7/1986 Roberts ..... 313/570
4,935,667 A * 6/1990 Geven et al. ..... 313/631
5,256,935 A * 10/1993 Dobashi et al. ..... 313/491
5,278,474 A * 1/1994 Nieda ..... 313/631
6,147,440 A * 11/2000 Scholz et al. ..... 313/113
2001/0038267 A1* 11/2001 Ono et al. ..... 315/106

FOREIGN PATENT DOCUMENTS

JP 07-296781 A 11/1995

* cited by examiner

*Primary Examiner*—Karabi Guharay
(74) *Attorney, Agent, or Firm*—David S. Safran

(57) ABSTRACT

A short arc discharge lamp has improved starting properties in which there is no danger of damaging the arc tube that surrounds a discharge space and in which the radiant light from the arc tube is not adversely shielded. This is achieved by providing the short arc discharge lamp with a first electrode having an electrical potential and to which a high voltage is applied, and a second electrode opposite the first at a in spaced relationship. Additionally, in the discharge space, there is positioned at least one conductive component with a tip projecting into the discharge space. The conductive component has an electrical potential which is identical to the electrical potential of the first electrode and has a tip spaced a distance from the second electrode which is greater than the distance between the first and the second electrode.

11 Claims, 8 Drawing Sheets

Fig. 8
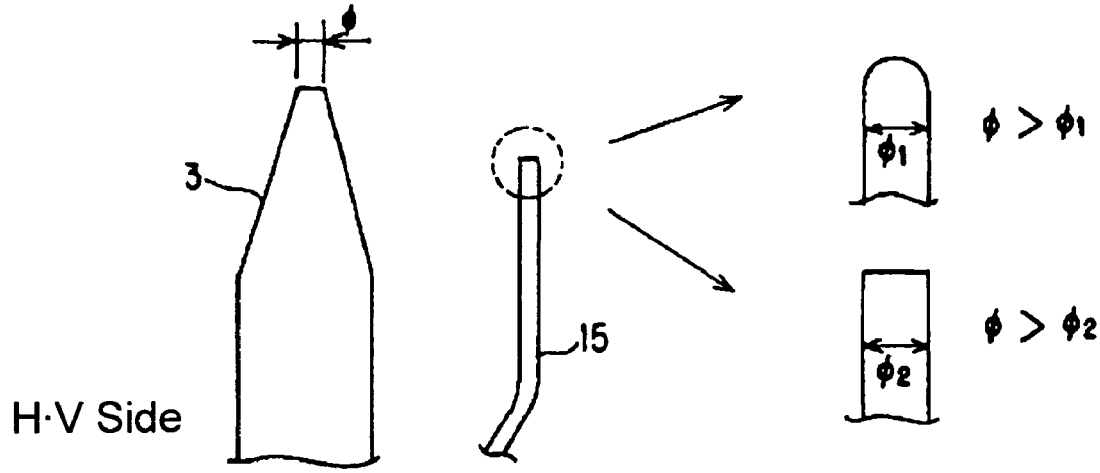
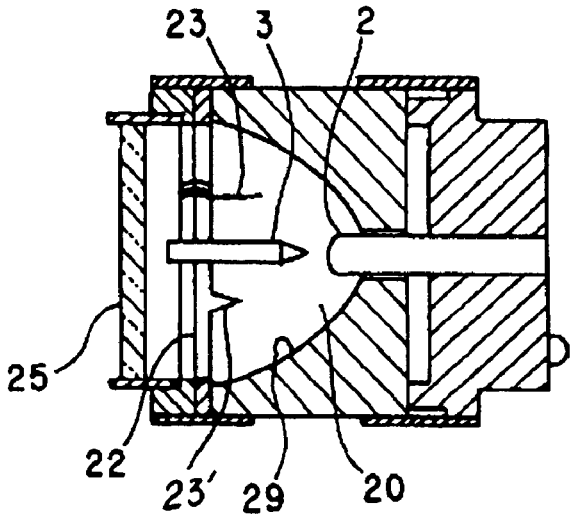
Fig. 9

Fig. 11 (Prior Art)
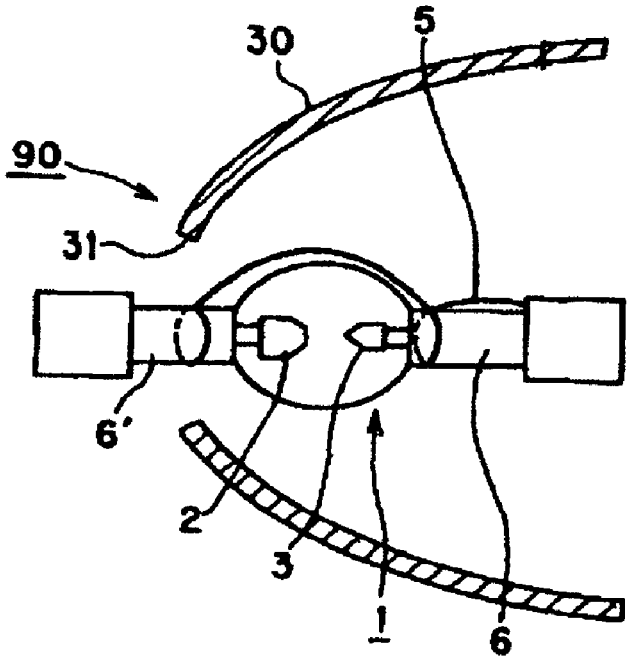
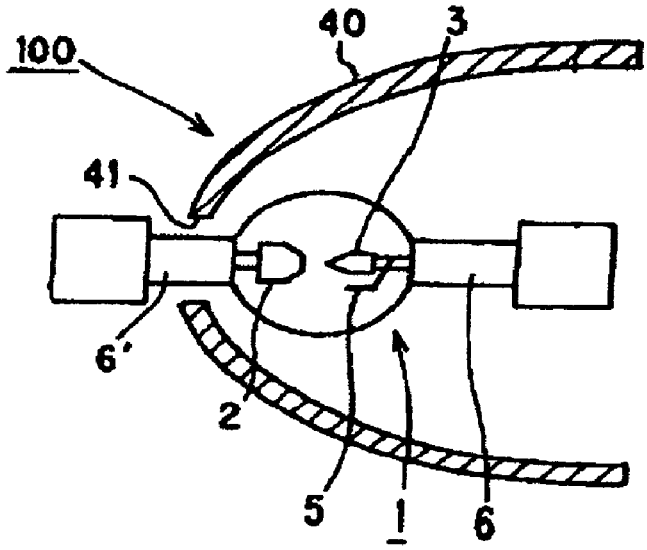
Fig. 12

SHORT ARC DISCHARGE LAMP AND LIGHT SOURCE DEVICE

BACKGROUND OF THE INVENTION

1. Field of the Invention

The invention relates to a short arc discharge lamp and a light source device using this lamp. The invention relates especially to an improvement of the starting properties of this short arc discharge lamp.

2. Description of the Related Art

In a short arc discharge lamp, in general, as shown in the schematic in FIG. 1, a trigger wire 5 is mounted on the outside of an arc tube 10, bridging two hermetically sealed portions, and is wound around the hermetically sealed portions 6. This trigger wire 5 has the function of lowering the breakdown voltage when the lamp starts. In FIG. 1, H.V. designates a high voltage pulse generator. The short arc discharge lamp is used for a DLP® projector (as made by Texas instruments), which is a high pressure rare gas discharge lamp. Since, in a high pressure rare gas discharge lamp, the filling pressure of the rare gas is high and the possibility is great that the lamp will easily break, it is undesirable to bring a foreign body into contact with the outside of the arc tube 10. However, since the increase of the filling gas pressure results in an increased breakdown voltage, a trigger arrangement is essential to facilitate the proper starting of the lamp. Consequently, the trigger wire 5 is mounted as was described above.

In the above described FIG. 1, there are the following disadvantages.

- In situations in which the arc tube is scratched, i.e., in the course of operation in the area on the outside of the arc tube 10 that has made contact with the trigger wire 5, crystallization takes place and in this way devitrification occurs.
- In the area in which the trigger wire 5 has been laid along the outside of the arc tube 10, the radiant light which is emitted by the arc tube 10 is shielded.
- During operation, the arc tube 10 reaches a high temperature and the trigger wire 5 becomes oxidized and degraded. Therefore, the starting ability is degraded with increased frequency of operation.
- When the trigger wire is positioned on the outside of the arc tube, high voltage breakdowns occur, which are dangerous when a short arc discharge lamp is combined with a concave reflector, i.e., when a light source device is formed in which the mirror surface is in close proximity to the arc tube. Therefore, it is difficult to increase the size of the focusing area.

SUMMARY OF THE INVENTION

A primary object of the present invention is to devise a short arc discharge lamp with a good starting property in which there is no danger of damaging the arc tube and in which the radiant light from the arc tube is not adversely affected.

A further object of the invention is to devise a light source device in which this discharge lamp is used and the focusing area is increased.

According to a first embodiment of the invention, a short arc discharge lamp is constructed having a discharge space surrounded by an arc tube in which a first high voltage electrode is situated to be at an electrical potential and spaced a distance from a second, opposite electrode. The objects of the invention are achieved by providing, in the discharge space, at least one conductive component with a tip projecting into the discharge space and having an electrical potential which is identical to the electrical potential of the first electrode. The tip is at a distance from the second electrode which is greater than the distance between the first and the second electrode.

The objects are also achieved by an embodiment of the invention where the tip of the conductive component is in contact with the inside wall of the arc tube or approaches the inside wall of the arc tube.

The objects of the invention are also achieved by a short arc discharge lamp having the conductive component located outside the area which lies around the electrode axis proceeding from the arc middle in the area of the light utilization angle.

The objects of the invention are still further achieved by a light source device in which one of the hermetically sealed portions of the above described short arc discharge lamp is pushed into the neck of a concave reflector.

The expression "short arc discharge lamp" of the invention is defined as a discharge lamp in which the added rare gas is Xe, Kr, or Ar or a gas mixture thereof, or a discharge lamp in which these gases are used as a buffer gas and in which mercury and/or at least one halogenated metal is added. The distance between the electrodes can be, for example, a few mm to roughly 10 and a few mm.

The area of the "light utilization angle" is the so-called light distribution angle. In FIG. 13, the light distribution angle is shown by a cross section which passes through the electrode axis. The area with the effective light utilization angle, viewed from the arc middle, is the area with the angle $\alpha$, i.e. the area which extends with this angle $\alpha$ around the electrode axis.

The conductive component is located in the discharge space outside the axis of the electrodes and has the same electrical potential as the electrode on the side to which the high voltage is applied. The high voltage is also applied to the above described electrical component, and the electrical field of the tip of this conductive component is locally intensified. The gas at this location reaches the breakdown voltage, by which ionization and a corona discharge (local discharge) form. In the lamp of the invention, it is assumed that the electromagnetic waves which are formed by the above described corona discharge induce electron emission from the cathode or the anode by the photoelectric effect. The breakdown voltage between the main electrodes is therefore reduced and thus the main discharge takes place.

The arrangement of the invention is such that the tip of the conductive component is located a distance from the electrode which is opposite the electrode to which the high voltage is applied and the distance is greater than the distance between the electrode receiving the high voltage and the electrode opposite it. Therefore, when the main discharge begins, the potential difference between the electrodes to which a few 10 kV have been applied during starting is lowered to a few dozen V, by which the field intensity at the start of ionization is not reached and by which the corona discharge is stopped.

In a high pressure rare gas discharge lamp which is represented by a xenon short arc discharge lamp, the filling pressure of the gas is high. At the tip of the conductive component, therefore, a corona discharge is easily limited. This can be an especially advantageous embodiment of the invention.

BRIEF DESCRIPTION OF THE DRAWINGS

FIG. 8 shows a schematic of another embodiment of the tip shape of a conductive component of the invention;

FIG. 9 shows a schematic of one embodiment of a high pressure discharge lamp of the invention;

FIG. 11 shows a schematic of a light source device of the conventional type;

FIG. 12 shows a schematic of a light source device of the invention; and

DETAILED DESCRIPTION OF THE INVENTION

Figure 1:
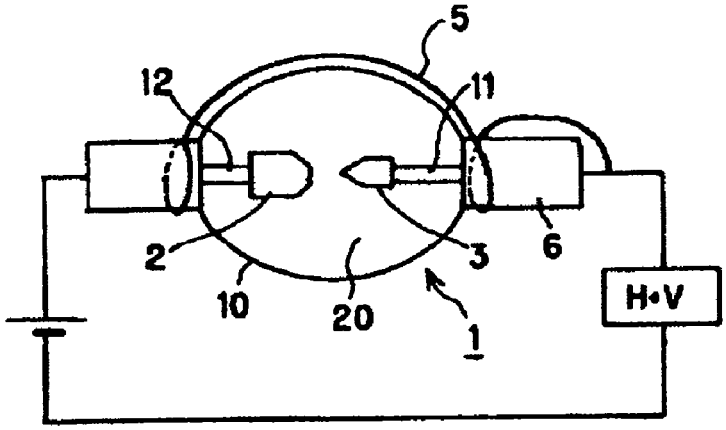
Fig. 1 (Prior Art)
FIG. 1 shows a schematic of a conventional high pressure discharge lamp.
Figure 2:
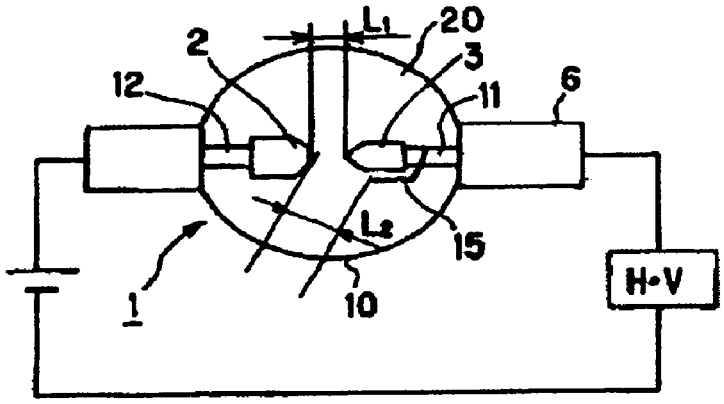
FIG. 2 shows a schematic of a high pressure discharge lamp of the invention.

FIG. 2 shows a schematic of a lamp of the invention in which a high pressure discharge lamp 1 has a discharge space 20 in which there is a pair of electrodes 2, 3 disposed opposite one another and in which, besides the anode 2 and the cathode 3, there is a conductive component 15 with a sharp tip with an electrical potential identical to the electrical potential of the electrode (cathode 3) on the side to which a high voltage from a high voltage pulse generator H-V is applied. The tip of the conductive component 15 is opposite the anode 2 a distance L2 which is larger than a distance L1 between the high voltage application electrode (cathode 3) and the electrode opposite it (anode 2) (L1<L2). The base point of the conductive component 15 is mounted on the upholding part of the electrode 11.

Figure 3A:
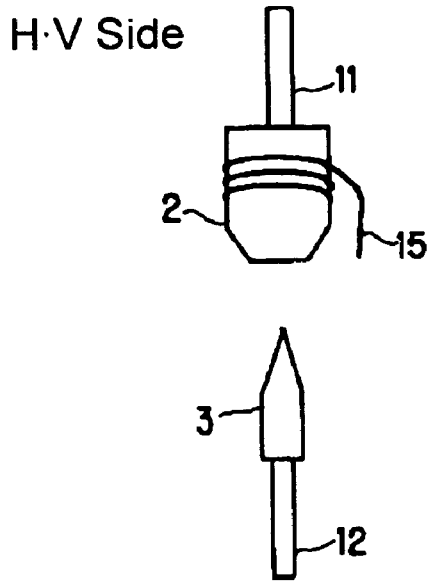
FIGS. 3(*a*) and 3(*b*) each show a schematic of one embodiment of the installation of a conductive component of the invention.
Figure 3B:
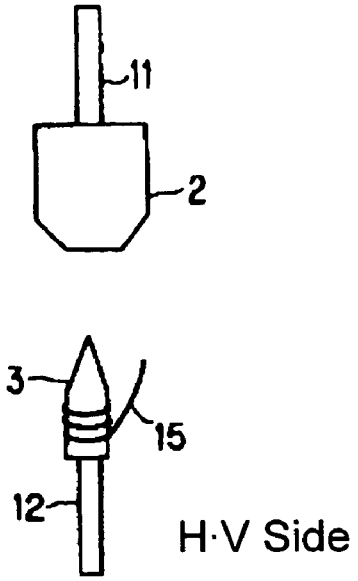
Figure 4A:
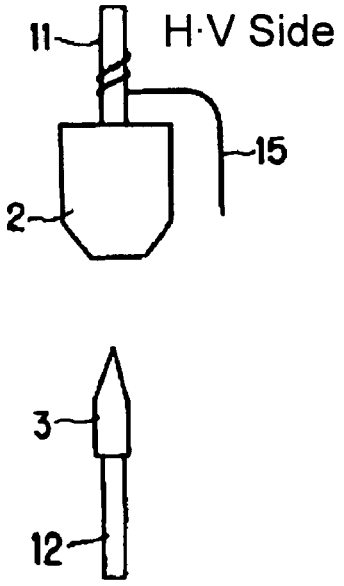
FIGS. 4(*a*) and 4(*b*) each show a schematic of another embodiment of the installation of a conductive component of the invention.
Figure 4B:
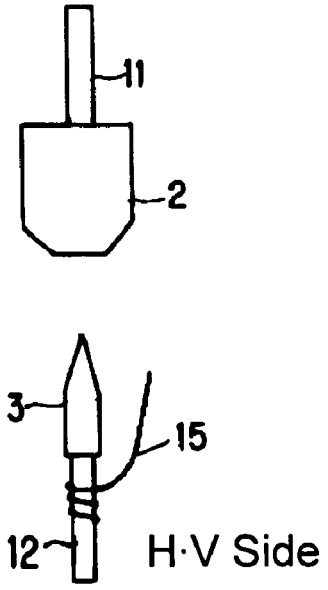
Figure 5A:
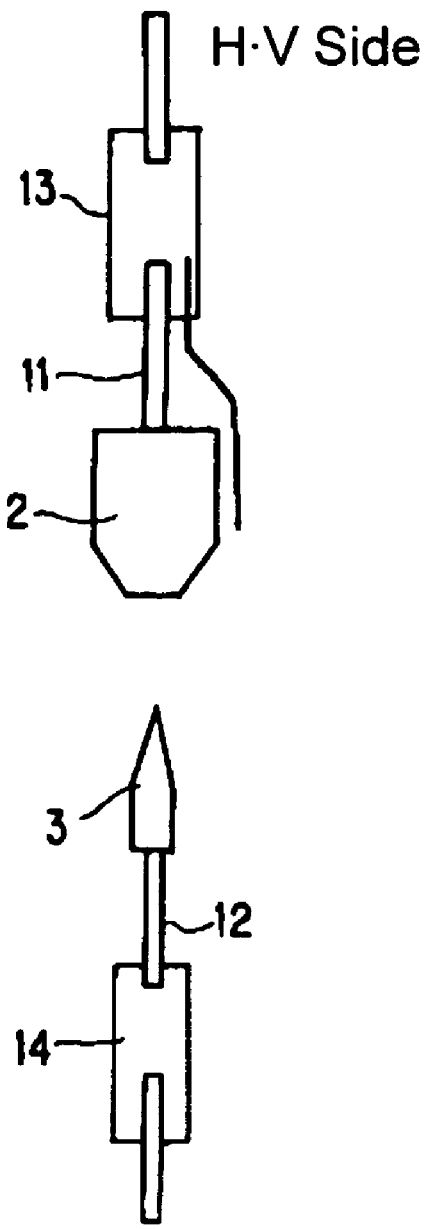
FIGS. 5(*a*) and 5(*b*) each show a schematic of still another embodiment of the installation of a conductive component of the invention.
Figure 5B:
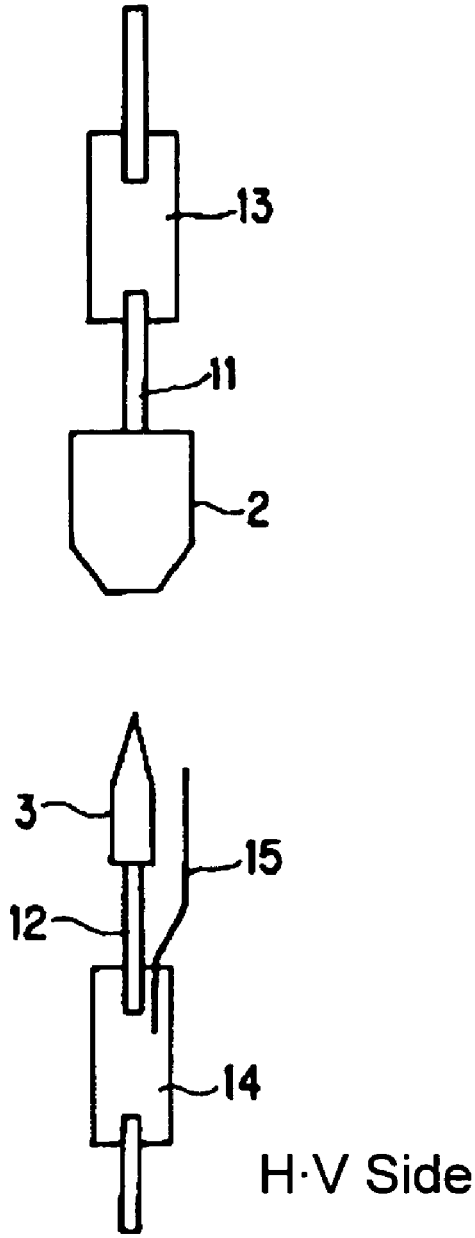
Figure 6:
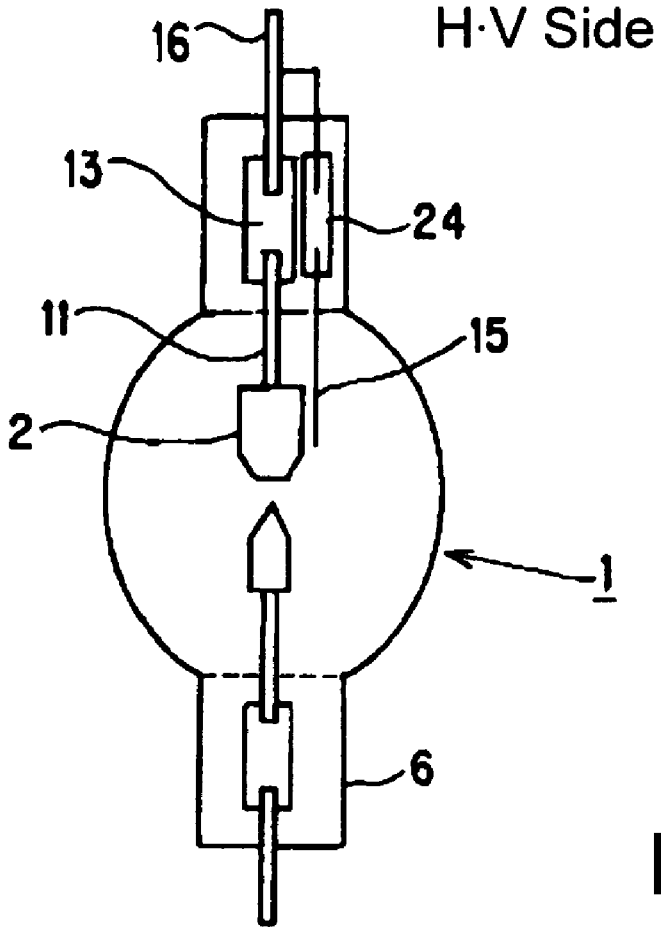
FIG. 6 shows a schematic of yet another embodiment of the installation of a conductive component of the invention.

The connection methods for attaching the conductive component 15 is as follows:

- wind around the elcctrode 2 (or 3) on the side to which the high voltage is applied (on the H-V side) and connect as shown in FIGS. 3(*a*) and 3(*b*);
- connect to the upholding part of the electrode 11 (or 12) which borders the electrode 2 (or 3) on the side to which the high voltage is applied, as is shown in FIGS. 4(*a*) and 4(*b*);
- connect to the hermetically sealed foil 13 (or 14) as is shown in FIGS. 5(*a*) and 5(*b*); and
- outside the lamp, connect to the feed line 16 of the electrode on the side to which the high voltage is applied via molybdenum foil 24, as is shown in FIG. 6.

If the material of the conductive component is a metal with a high melting point such as Mo, W, Ta, Zr and the like as the carrier (substrate) metal and if at least the tip area of this component contains a material with a low (electron) work function such as Th, La, Ce, Hf, Ba and the like, the discharge is started with a lower voltage than in the case in which only metals with a high melting point such as Mo, W, Ta, Zr and the like are contained.

Figure 7:
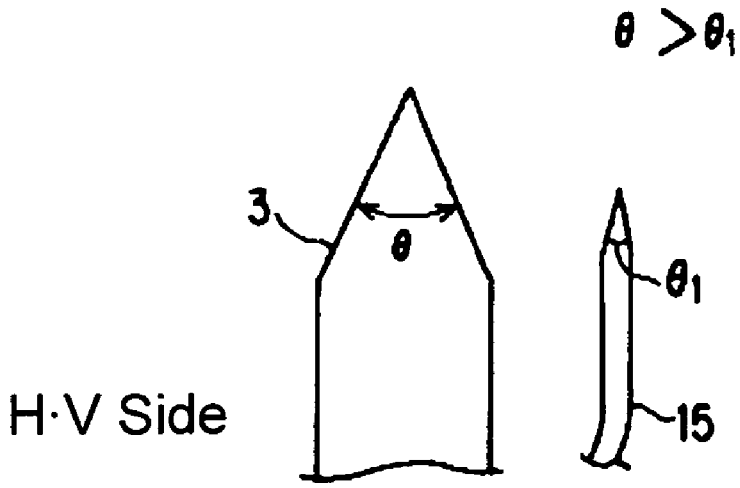
FIG. 7 shows a schematic of an embodiment of the tip shape of a conductive component of the invention.

As is shown in FIG. 7, the shape of the tip of conductive component is preferably of a smaller diameter than the two electrodes in the arc tube and that its tip has a vertex angle $\theta_1$ which is smaller than the angle $\theta$ of the conical area (cone part) of the electrode tip which is located in the vicinity of the conductive component ($\theta>\theta_1$). This is because the electrical field is concentrated and amplified more as the angle becomes smaller. Furthermore, as shown in FIG. 8, it is desirable that the tip diameters ($\Phi_1$, $\Phi_2$) of the conductive component 15 are smaller than the tip diameter ($\Phi$) of the electrode which is located in the vicinity of the conductive component ($\Phi>\Phi_1>\Phi_2$). This is because the electrical field is concentrated more as the tip diameter becomes smaller. The conductive component of the invention can be for example rod-like or needle-like with a sharp tip. However, the tip need not always be sharp, but can also be round or angular, as shown in FIG. 8, if the conductive component is inherently narrow. The area outside the tip of the conductive component can also be plate-shaped. If there are several conductive components, a corona discharge begins from the tip of each respective conductive component.

FIG. 9 is a schematic cross section of a ceramic xenon arc discharge lamp with a mirror installed integrally. The conductive component in this lamp is formed by winding the support column 22 of the cathode 3 with a metal wire 23. The tip of this metal wire 23 is located parallel to the cathode 3 in the direction to the anode 2. Further, the conductive component, as shown in FIG. 9, can be formed such that the support column 22 of the cathode 3 is deformed and that in this way a projection 23' with an acute angle is formed. Furthermore, the conductive component can also be installed directly in the cathode 3 (not shown). The illustrated lamp also has a translucent front plate 25 of sapphire and a reflector surface 29.

FIG. 11 shows a conventional light source device 90 for a short arc discharge lamp. FIG. 12 shows a short arc discharge lamp 100 of the invention. In the conventional light source device 90 of FIG. 11, the breakdown voltage between the wire and the mirror is lower than the breakdown voltage between the electrodes when the distance between the outside trigger wire 5 which is wound around the hermetically sealed portion 6' and the opening 31 in the neck of the concave reflector 30 is small. In this way, a discharge occurs prematurely, by which there is the danger of breakdown of the high voltage. Conventionally, therefore, the opening diameter of the opening 31 of the neck is made large to avoid this problem. On the other hand, in the light source device 100 of the invention, since there is no danger of a high voltage breakdown, the opening diameter of the opening 41 of the neck can be made smaller than in a conventional light source device. In this way, a smaller concave reflector 40 is obtained. The diameter of the front opening of the concave reflector 40 can also be made smaller the result of which is that the focusing efficiency increases.

Figure 13:
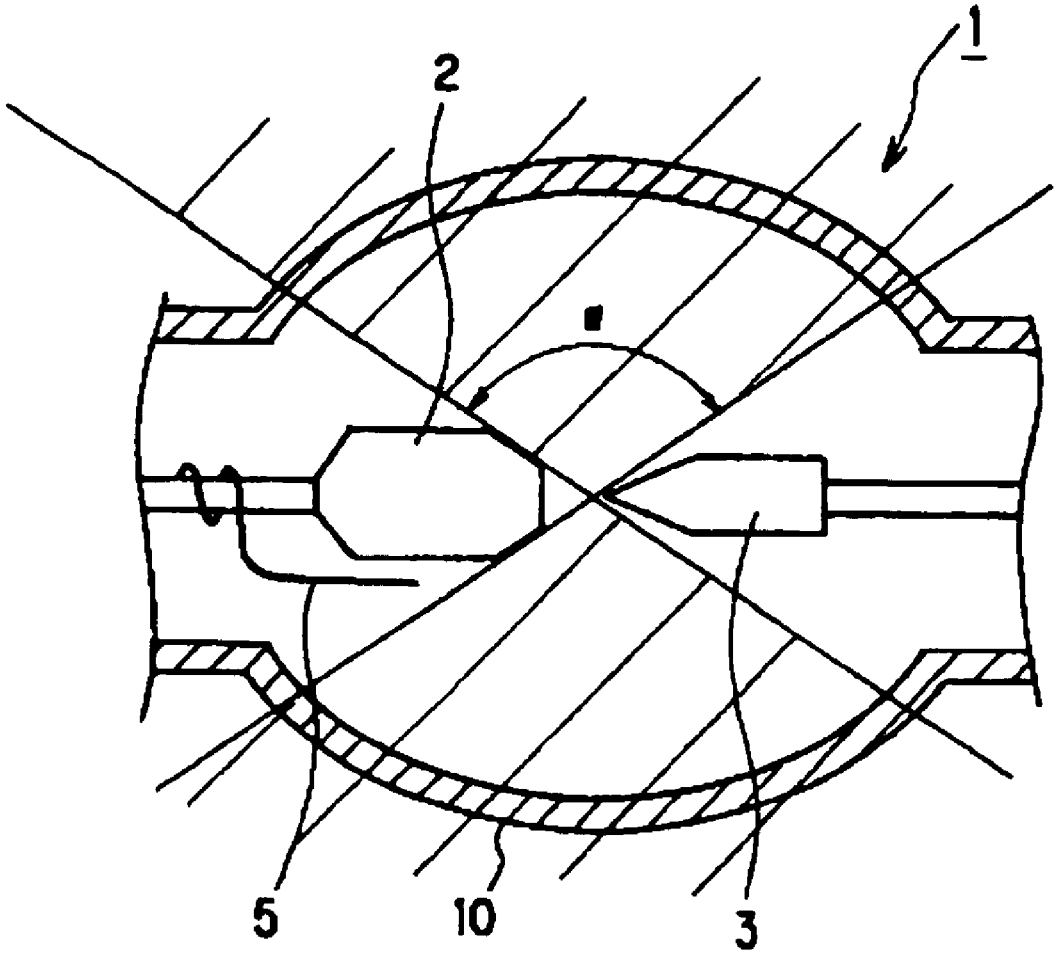
FIG. 13 shows a schematic of the effective light utilization angle.

FIG. 13 shows another embodiment of the conductive component of the invention. In this embodiment, the conductive component is outside the area of the effective light utilization angle proceeding from the arc middle and extending around the electrode axis, i.e. the conductive component is outside the area with an angle $\alpha$ in the FIG. 13, such that radiation from the main electrode is not disturbed. Such an embodiment is advantageous with respect to the degree of utilization of the light from the lamp.

Next, as a specific example of the invention, a high pressure xenon lamp for a DLP projector with an output wattage of 2 kW, a xenon fill pressure of 2 MPa, and a distance between the electrodes of 5 mm, is provided with a conductive component positioned within an arc tube. In one example, a molybdenum (Mo) line 27 is attached to a glass tube (FIG. 10(*b*)) of a lamp material component, has a diameter of 0.2 mm, extends in the arc tube and is made the conductive component. In another example, the Mo line 27 is wound around the upholding part of the electrode 28 (FIG. 10(*a*)) and its tip was placed with a distance from the electrode which is opposite the high voltage application electrode, this distance being greater than the distance between the high voltage application electrode and the electrode opposite it. The Mo line 27 of this example was cut off obliquely such that its tip becomes sharp. In this situation, the Mo line 27 is wound around the upholding part of the electrode 28 and therefore is connected to the upholding part of the electrode 28. A test to confirm the starting properties was carried out with the following three versions.

Test to Confirm the Starting Property

Figure 10A:
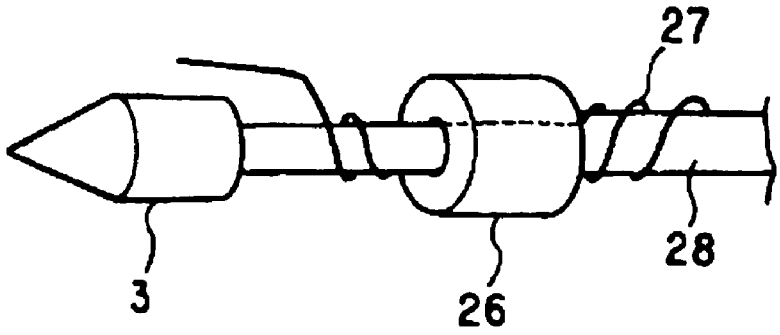
FIGS. 10(*a*) and 10(*b*) each show a schematic of one example which confirms the action of the invention.
Figure 10B:
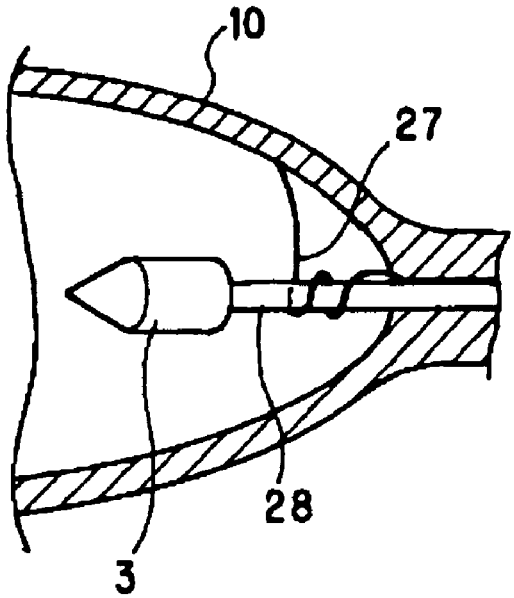

As shown in FIG. 10(*a*), the Mo line 27 is located parallel to the cathode 3 and its tip is located in the vicinity of a point at which the bevel of the cone-like area of the cathode begins.

As is shown in FIG. 10(*b*), the tip of the Mo line 27 is arranged such that it comes into contact with the inside wall of the arc tube 10.

Similarly to the version as shown in FIG. 10(*b*), the tip of the Mo line 27 is arranged such that it is located at a very short distance of up to 1 mm from the arc tube 10, but does not contact the arc tube.

Two lamps at a time were produced with a conventional arrangement of the trigger wire outside the arc tube and with the above described three versions. The breakdown voltage was determined for them.

The result of measuring the breakdown voltage during the starting operation is described below. In the case of conventional winding of the trigger wire outside the arc tube the breakdown voltage of the lamps was 30 kV to 33 kV. Conversely, the breakdown voltage in the versions of the invention was 25 kV to 27 kV for first version and 22 kV to 24 kV for second and third versions. The breakdown voltage has therefore decreased to a large extent.

In the case of the three versions of the invention, there is no degradation of the conductive component by oxidation because the conductive component is located within the lamp. Therefore, the starting property is not degraded at the end of the lamp service life. The phenomenon which occurred in the arc tube for each version was the following:

In the first version, when a high voltage was applied to the tip of the Mo line 27 of the conductive component a discharge similar to fireworks formed. In the second and third versions, a discharge propagated from the tip of the conductive component to the inside wall of the bulb in the manner of a spider's web. It can be assumed that it was formed by a corona discharge passing from the discharge form into a creeping discharge along the inside of the glass.

From the aforementioned result the following can be assumed:

At a voltage (roughly 10 kV) which is lower than the breakdown voltage between the main electrodes, a corona discharge is formed proceeding from the tip of the Mo line. The electromagnetic waves which are produced by this discharge can induce electron emission by the photoelectric effect from the cathode or anode and thus can reduce the breakdown voltage between the main electrodes. When the main discharge begins, the potential difference between the electrodes to which a few 10 kV were applied during starting decreases to a few dozen V, such that the field intensity at the start of ionization is not reached and the corona discharge is stopped so that only the main discharge is continued.

In the description above, a lamp of the direct current type is shown by way of example. However, the conductive component inside is active independently of whether a direct current or alternating current is used, even if the lamp is started by applying a high voltage to the component in a lamp via an alternating current type. It can be imagined that the action of the invention is, of course, also achieved in doing by so starting the lamp.

As was described above, according to the first embodiment of the invention, a short arc discharge lamp is obtained with good starting property, in which there is no danger of damage to the arc tube by a trigger wire positioned outside the arc tube. In this first embodiment, in a short arc discharge lamp having a discharge space, there is a pair of electrodes opposite one another. In the discharge space, besides these electrodes there is at least one conductive component where the electrical potential of this conductive component is identical to the electrical potential of the electrode on the side to which the high voltage is applied. Further, the tip of the above described conductive component is at a distance from the electrode which is opposite the electrode to which the high voltage is applied, this distance being greater than the distance between the electrode on the high voltage application side and the electrode opposite it.

Furthermore, a short arc discharge lamp with an even better starting property can be obtained by the embodiment in which the tip of the conductive component is in contact with the inside wall of the arc tube or is close to it.

Additionally, a short arc discharge lamp, with high efficiency of light usage, is obtained in which the radiant light from the arc tube is not adversely effected by the conductive component located outside the area which extends around the electrode axis proceeding from the arc center in the effective light utilization angle.

Moreover, the light source device of the invention includes a device in which there is a concave reflector in which one of the hermetically sealed portions of the short arc discharge lamp is pushed into the neck of the concave reflector. In such an embodiment, a light source device with a short arc discharge lamp is obtained in which the diameter of the mirror opening can be made small and in which the focusing area is enlarged without adversely affecting the radiant light of the arc tube.

What is claimed is:

1. A high pressure rare gas short arc discharge lamp which includes a discharge space surrounded by an arc tube and in which, within the arc tube, a first electrode is positioned at a distance from a second opposed electrode, comprising, at least one conductive component having a tip projecting into the discharge space and having an electrical potential which is identical to an electrical potential applied to the first electrode, wherein the first electrode is connected to a high voltage pulse generator for receiving a high voltage therefrom, wherein the tip is at a distance from the second electrode which is greater than the distance between the first and the second electrode; and wherein the conductive component is located outside the area which is at an effective light utilization angle extending from the arc middle rotating around the electrode axis.

2. A high pressure rare gas short arc discharged lamp which includes a discharge space surrounded by an arc tube and in which, within the arc tube, a first electrode is positioned at a distance from a second opposed electrode, comprising, at least one conductive component having a tip projecting into the discharge space and having an electrical potential which is identical to an electrical potential applied to the first electrode, wherein the first electrode is connected to a high voltage pulse generator for receiving a high voltage therefrom, wherein the tip is at a distance from the second electrode which is greater than the distance between the first and the second electrode; and wherein the tip of the conductive component is in contact with the inside wall of the arc tube.

3. Short arc discharge lamp as claimed in claim 1, wherein the tip of the conductive component is in close proximity to an inside wall of the arc tube without contacting the inside wall.

4. Short arc discharge lamp as claimed in claim 1, wherein the conductive component is connected to an upholding part of the first electrode.

5. Short arc discharge lamp as claimed in claim 1, wherein the conductive component is connected to the first electrode.

6. Short arc discharge lamp as claimed in claim 1, wherein the conductive component is connected to a molybdenum foil which is electrically connected to an upholding part of the first electrode.

7. Short arc discharge lamp as claimed in claim 1, wherein the conductive component is connected to an outer lead which is connected electrically conductively to the first electrode.

8. Short arc discharge lamp as claimed in claim 1, wherein the conductive component has a smaller diameter than a diameter of first or the second electrodes.

9. Short arc discharge lamp as claimed in claim 1, wherein the tip of the conductive component has a tip angle which is smaller than an angle of a cone-like area of a tip of the first electrode.

10. Short arc discharge lamp as claimed in claim 1, wherein the conductive component is composed of at least one of the metals Mo, W, Ta, and Zr and at least the area of the tip of the conductive component contains material selected from the group consisting of at least one of the metals Th, La, Ce, Hf, and Ba.

11. Light source device comprising a concave reflector having a neck portion; and a high pressure rare gas short arc discharge lamp which includes a discharge space surrounded by an arc cube and in which, within the arc tube, a first electrode is positioned at a distance from a second opposed electrode, at least one conductive component having a tip projecting into the discharge space and having an electrical potential which is identical to an electrical potential applied to the first electrode, the tip being at a distance from the second electrode which is greater than the distance between the first and the second electrode, wherein the first electrode is connected to a high voltage pulse generator for receiving a high voltage therefrom, wherein a hermetically sealed portion of the short arc discharge lamp is located in the neck portion of the concave reflector; and wherein the tip of the conductive component has a tip angle which is smaller than an angle of a cone-like area of a tip of the first electrode.

* * * * *